US010351214B2

(12) United States Patent
Aylward

(10) Patent No.: US 10,351,214 B2
(45) Date of Patent: Jul. 16, 2019

(54) MOORING BUOY

(71) Applicant: Maritime Heritage Marine Products, LLC, Cromwell, CT (US)

(72) Inventor: Allan Aylward, Cromwell, CT (US)

(73) Assignee: MARITIME HERITAGE MARINE PRODUCTS, LLC, Cromwell, CT (US)

( * ) Notice: Subject to any disclaimer, the term of this patent is extended or adjusted under 35 U.S.C. 154(b) by 0 days.

(21) Appl. No.: 15/887,081

(22) Filed: Feb. 2, 2018

(65) Prior Publication Data

US 2018/0222555 A1 Aug. 9, 2018

Related U.S. Application Data

(60) Provisional application No. 62/456,356, filed on Feb. 8, 2017.

(51) Int. Cl.
*B63B 22/02* (2006.01)

(52) U.S. Cl.
CPC ..... *B63B 22/02* (2013.01)

(58) Field of Classification Search
CPC ..... B63B 22/02
USPC ..... 441/1, 3
See application file for complete search history.

(56) References Cited

U.S. PATENT DOCUMENTS 2,354,441 A 7/1944 Diehl
2,381,394 A 8/1945 Beach, Jr.
2,701,375 A * 2/1955 Ault ..... B63B 22/021 114/264
2,814,054 A * 11/1957 Phillips ..... E02B 3/24 441/3
2,814,055 A 11/1957 Phillips
2,943,590 A 7/1960 Andersen
2,955,561 A * 10/1960 Andersen ..... B63B 22/02 114/230.1
3,077,614 A 2/1963 Lloyd
3,110,046 A 11/1963 Fischer
3,195,498 A * 7/1965 Johns ..... E02B 3/24 114/230.18
3,464,214 A 9/1969 King
3,568,228 A 3/1971 Rudelick
3,604,030 A 9/1971 Claflin
3,695,209 A * 10/1972 Giese ..... E02B 3/24 114/230.15
3,860,983 A * 1/1975 Furth ..... B63B 22/02 114/333
3,950,806 A * 4/1976 Puchois ..... B63B 22/02 441/3
4,602,586 A * 7/1986 Ortloff ..... B63B 22/021 114/230.14

(Continued)

FOREIGN PATENT DOCUMENTS

GB 2209146 B 2/1992

*Primary Examiner* — Lars A Olson
*Assistant Examiner* — Jovon E Hayes
(74) *Attorney, Agent, or Firm* — Volpe and Koenig, P.C.

(57) ABSTRACT

A mooring buoy that has lower and upper surfaces and an opening positioned on a vertical centerline between the lower and upper surfaces. A raceway has a first portion that extends though the opening for predetermined a distance below the lower body surface and a predetermined distance above the upper body surface. The raceway has a portion that extends away from the centerline and over the upper surface.

10 Claims, 3 Drawing Sheets

(56) References Cited

U.S. PATENT DOCUMENTS

| | | | | | |
|---|---|---|---|---|---|
| 4,699,075 | A | | 10/1987 | Tortorici | |
| 5,328,353 | A | * | 7/1994 | Keenan | E02B 15/042 431/2 |
| 5,690,047 | A | * | 11/1997 | Holmes | B63B 21/22 114/294 |
| 6,488,554 | B2 | * | 12/2002 | Walker | B63B 22/02 114/230.2 |
| 8,082,868 | B1 | * | 12/2011 | Johnson | B63B 21/00 114/230.1 |

* cited by examiner

MOORING BUOY

This application claims the benefit of U.S. Provisional Application Ser. No. 62/456,356, filed on Feb. 8, 2017, which is incorporated by reference as if fully set forth.

FIELD OF INVENTION

The invention provides a mooring buoy with ready access to a lead for tying up to the buoy. A mooring buoy is a floating docking point located in open water so it is accessible to a boater. The anchoring assembly has a heavy weight located on the bottom to anchor the floating buoy in the water. A typical mooring buoy has attached rope loops or chains with at least one segment that that is available to a boater so that it can be grabbed and the vessel can be moored to the buoy.

BACKGROUND

The known or typical buoys present the problem that the rope loops or chains are typically at rest in the water when the boater wishes to anchor to the buoy. Accordingly, a boater must fish the rope from the water in order to tie up. This presents multiple issues, one it can be difficult to catch the lead and, two, the lead is often soaked with water, which increases the weight, and has algae or other debris attached to it, and there is potential for passing boats or the anchoring boats' propeller to become entangled in the floating rope. Accordingly, it is desired to have a mooring buoy that provides easier access to the lead and keeps the lead from soaking in the water so it is clean and visible.

SUMMARY

The disclosed buoy provides a surface float with a physical extension that maintains the tie up lead above the water's surface and presents it to a boater in a more easily reached position. The disclosed buoy may also include a battery or solar powered signal light attached to the physical extension.

BRIEF DESCRIPTION OF THE DRAWING(S)

DETAILED DESCRIPTION OF THE PREFERRED EMBODIMENT

Figure 1:
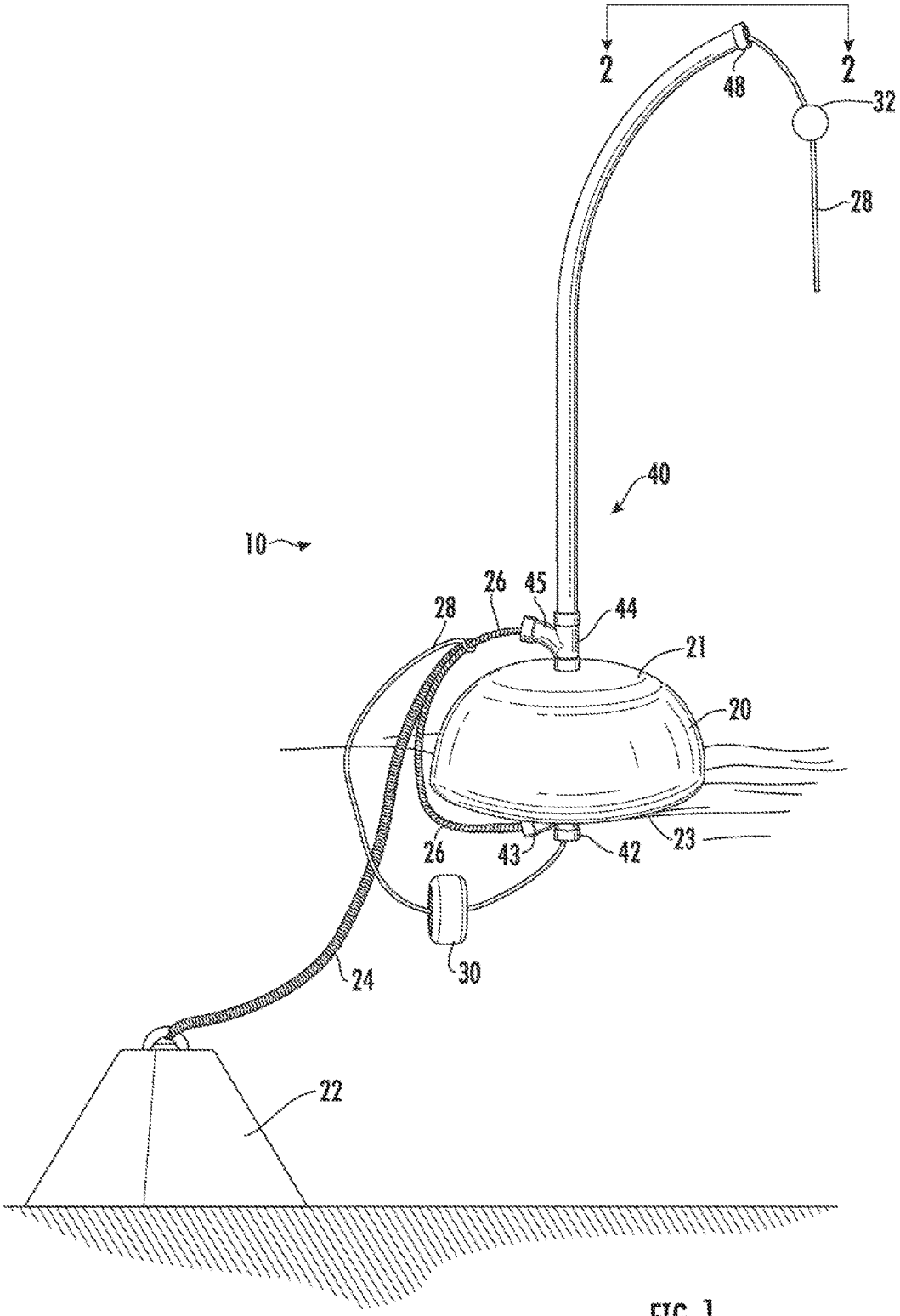
FIG. 1 illustrates the present mooring buoy in a typical anchored assembly.
Figure 2:
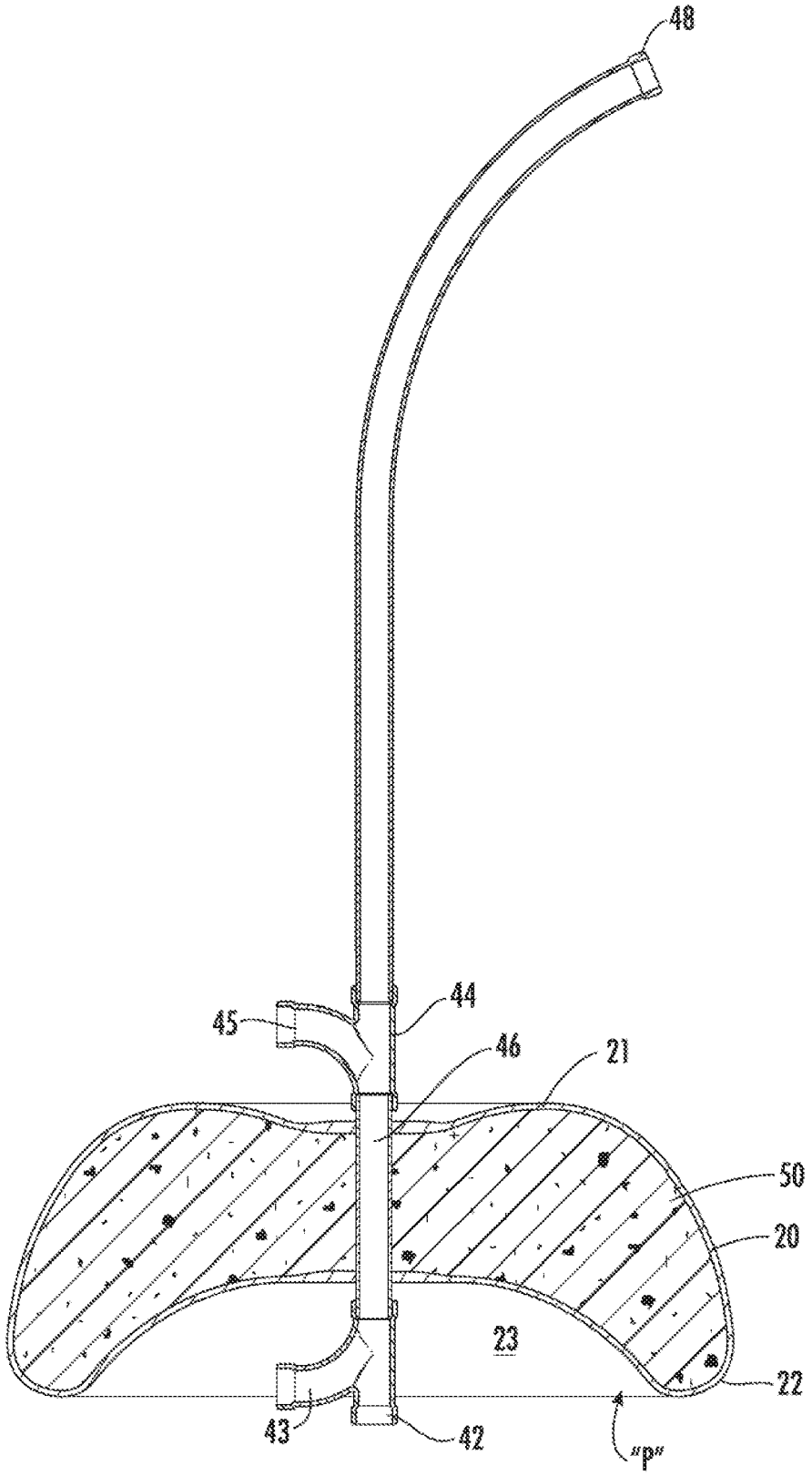
FIG. 2 is a section view of the mooring buoy in FIG. 1, without any anchoring chains or ropes.

With reference to FIGS. 1 and 2, the mooring buoy assembly 10 is anchored to the bottom in the typical fashion. The buoy body 20 is held by an anchor 22 and the two of them are connected in the usual fashion. Typically, a length of chain 24 extends up to and connects with a second length of chain or rope 26 that is looped through the buoy body 20. This is loop accomplished through the elbow shaped couplings 42 and 44 and the intermediate connecting tube 46, see FIG. 2. The second length of chain passes through the elbows 43 and 45 to form the loop. The mooring lead or tether 28 is connected at one end to the chain 26 with a free end that enters the vertical extension 40 at the free end of coupling 42 and passes up and out of the extension arm 40, which is bent off the vertical to present the free end 48 toward an approaching boater. A weight 30, illustrated here as a donut shaped weight, is place between the anchored end of tether 28 and the entry of the tether 28 into the vertical extension 40. Weight 30 acts to pull the tether 28 back into extension 40. In order to prevent the tether 28 from being pulling through extension 40 a stopper 32 is provided at a location that exposes a desired length of tether available to a boater. As illustrated, stopper 32 has a round or ball shape that is larger than the open at free end 48; however, the stopper 32 could be a washer like rubber disc 30', shown in FIG. 3, to present a flatter surface to a boater for capturing the lead 28.

With reference to FIGS. 1 and 2, the body 20 and the hollow tubing, couplings 42 and 43, connecting tube 46 and extension arm 40, are all preferable made of marine plastic. The extension arm 40 preferable extends at least two feet above the top surface 21 of the buoy body 20 to keep the tether accessible. As shown in FIG. 1, the union 42 preferably extends below the lower surface 23 to provide access points for the chain 26 and tether 28 without interfering with the buoyance of the buoy body 20. As can be seen from FIG. 2, the hollow tubing, couplings 42 and 43, connecting tube 46 and extension arm 40 form a raceway or conduit for the chain 26 and tether 28.

With reference to FIG. 2, it can be seen that buoy body 20 is dome shaped with a slight central depression 21 and a round lower edge 22 that defines the bottom plane "P." The concave lower surface 23 of buoy body 20 is disposed inwardly from the plane "P" and forms a recess in the buoy body 20. The recess formed by the concavity of surface 23 increases the contact surface with the water and adds to the stability of the buoy body 20.

Still with reference to FIG. 2, the buoy body 20 is hollow and filled with unicellular plastic foam that complies with all applicable regulation set forth in 46 CFR 160.056-2 and CFR 179.240 and any applicable coast guard rules or regulations.

Still with reference to FIG. 2, foam 50 preferably is molded about the connector 46. This avoids the need to drill the foam and provides a bond that stabilizes the connector 46 on the vertical centerline through the buoy body 20.

Figure 3:
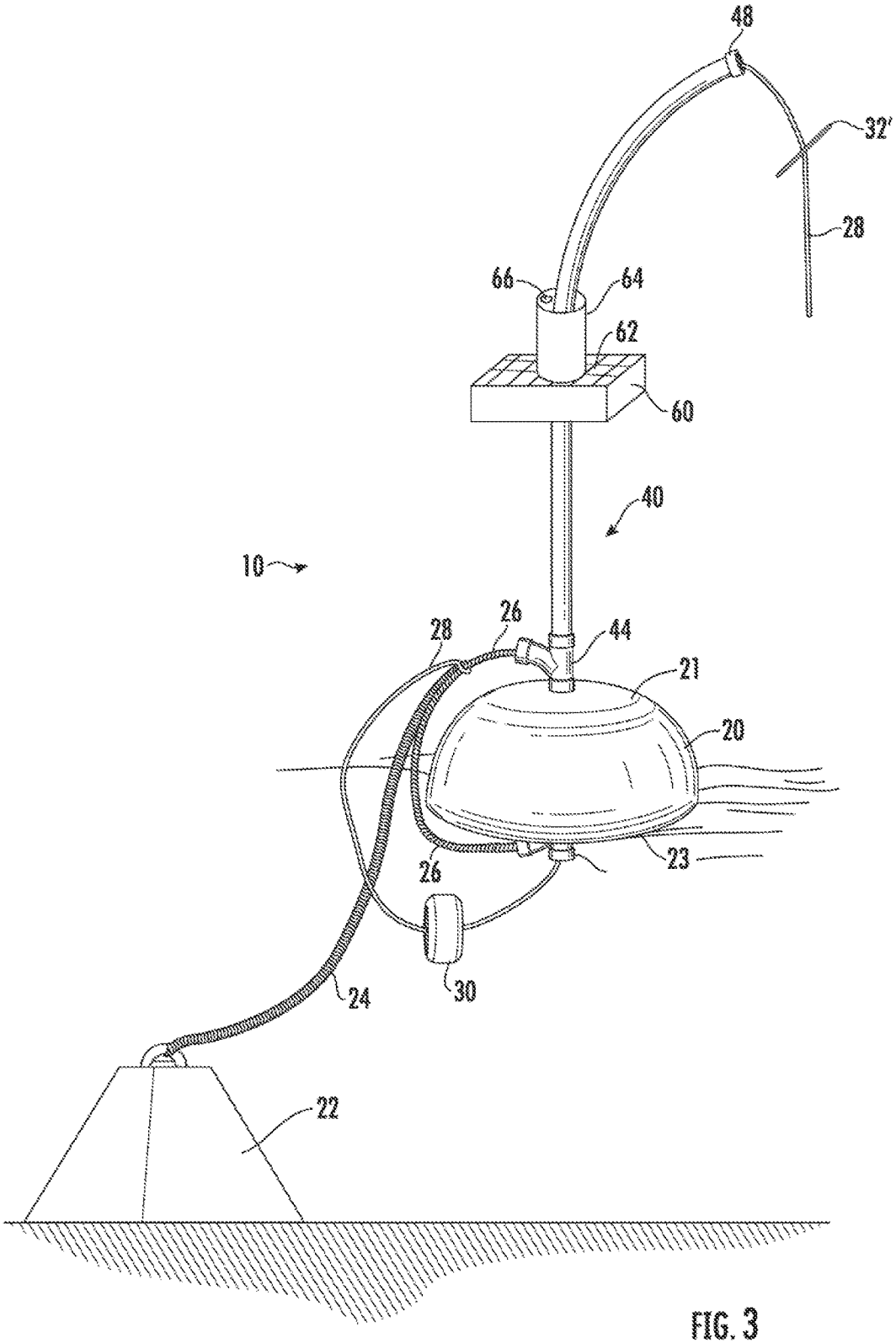
FIG. 3 illustrates the mooring buoy of FIG. 1 with an optional signal light.

With reference to FIG. 3, the buoy is illustrated with an optional marker light that is battery or solar powered. The optional power pack 60 preferable has an upper surface 62 that is an array of solar cells for charging the battery or for directly powering the marker light 54. Preferably, the light 64 is associated with a photo cell 66 that will turn off the light 64 during day light hours to conserve power.

What is claimed is:

1. A mooring buoy comprising:

a hollow, plastic foam filled flotation body that has a lower body surface and an upper body surface and an opening between the lower body surface and the upper body surface that is located on a vertical centerline through the flotation body; and a raceway that has a first portion that extends though the opening between the lower body surface and the upper body surface for a predetermined distance below the lower body surface and a predetermined distance above the upper body surface and has at least one second portion that extends away from the centerline and over the upper body surface, and at least one third portion that extends away from the centerline and under the lower body surface; and, a power source and signal light.

2. A mooring buoy comprising a flotation body that has a lower body surface and an upper body surface and an opening between the lower body surface and the upper body surface that is located on a vertical centerline through the flotation body; and a raceway that has a first portion that extends though the opening between the lower body surface and the upper body surface for a predetermined distance below the lower body surface and a predetermined distance above the upper body surface and has at least one second portion that extends away from the centerline and over the upper body surface, and at least one third portion that extends away from the centerline and under the lower body surface and a tether is positioned within the raceway.

3. The mooring buoy of claim 2, wherein the tether has a portion that extends out of the raceway.

4. The mooring buoy of claim 3, further comprising a stopper attached to the tether portion that extends out of the raceway.

5. The mooring buoy of claim 1, wherein the flotation body is filled with plastic foam that is molded about the raceway.

6. A mooring buoy comprising:

a flotation body that has a lower surface, an upper surface and a vertical centerline that extends through the lower surface and the upper surface;

a hollow extension element that extends above the upper surface for a first predetermined vertical distance and terminates is a free end;

a lead that is supported within the hollow extension element and extends out of a free end of the hollow extension element; and, a stop element that connects to the lead in a position that abuts the free end of the hollow extension element.

7. The mooring buoy of claim 2 further comprising a power source and signal light.

8. The mooring buoy of claim 6 further comprising a power source and signal light.

9. The mooring buoy of claim 2, wherein the flotation body is hollow and filled with plastic foam.

10. The mooring buoy of claim 6, wherein the flotation body is hollow and filled with plastic foam.

* * * * *